US007770271B2

(12) United States Patent
Kleiner et al.

(10) Patent No.: US 7,770,271 B2
(45) Date of Patent: Aug. 10, 2010

(54) METHOD AND DEVICE FOR OPERATING A CREEL DESIGNED FOR A WINDING SYSTEM AND CORRESPONDING CREEL

(75) Inventors: Andreas Kleiner, Niederhelfenschwil (CH); Alfred Jakob, Niederuzwil (CH)

(73) Assignee: Karl Mayer Textilmaschinen, Uzwil (CH)

( * ) Notice: Subject to any disclaimer, the term of this patent is extended or adjusted under 35 U.S.C. 154(b) by 485 days.

(21) Appl. No.: 11/910,139

(22) PCT Filed: Mar. 10, 2006

(86) PCT No.: PCT/EP2006/060619

§ 371 (c)(1),
(2), (4) Date: Sep. 28, 2007

(87) PCT Pub. No.: WO2006/103156

PCT Pub. Date: Oct. 5, 2006

(65) Prior Publication Data

US 2008/0191085 A1 Aug. 14, 2008

(30) Foreign Application Priority Data

Mar. 30, 2005 (EP) ..... 05102526

(51) Int. Cl.
*D02H 13/24* (2006.01)

(52) U.S. Cl. ..... 28/190; 28/185; 28/194

(58) Field of Classification Search ..... 28/185, 28/190, 194, 186–189; 242/416, 419, 419.1, 242/413.5, 413.9, 130, 131, 131.1, 147 R, 242/156, 156.1, 156.2

See application file for complete search history.

(56) References Cited

U.S. PATENT DOCUMENTS 3,648,338 A * 3/1972 Mruk ..... 28/185

(Continued)

FOREIGN PATENT DOCUMENTS

DE 3222613 12/1983

(Continued)

*Primary Examiner*—Amy B Vanatta
(74) *Attorney, Agent, or Firm*—Shoemaker and Mattare

(57) ABSTRACT

The invention concerns a creel (2) comprising a plurality of winding heads (7) from which several yarns of the same type or of different types are drawn simultaneously by means of a winding machine (3). Said creel comprises at least one dynamic yarn tension device (6) which is associated with each winding head and at which a variable braking force is applied to the yarn to produce a predetermined yarn tension. Each yarn tension device (6) can be activated by means of an associated drive motor (20). Said creel (2) comprises a control device for controlling the yarn tension based on the angular speed or the yarn speed during a start-up and/or an interruption of the winding machine (3), as well as a regulator (25) for regulating the yarn tension during the normal stationary phase of the winding machine (3). The control device and the regulator (25) are designed such that the yarn tension or the output tension of each yarn can be maintained at a substantially constant level relative to a setpoint value. In order to determine a quantity of regulation (32) of the braking force required to control the yarn tension device (6), a precompensation of the disturbing quantity is implemented. Said precompensation calculates from the yarn speed (v) as input quantity a compensated correction quantity (34) of at least the inertia of the motor and a friction coefficient of the drive motor (20).

13 Claims, 7 Drawing Sheets

U.S. PATENT DOCUMENTS

Figure 1:
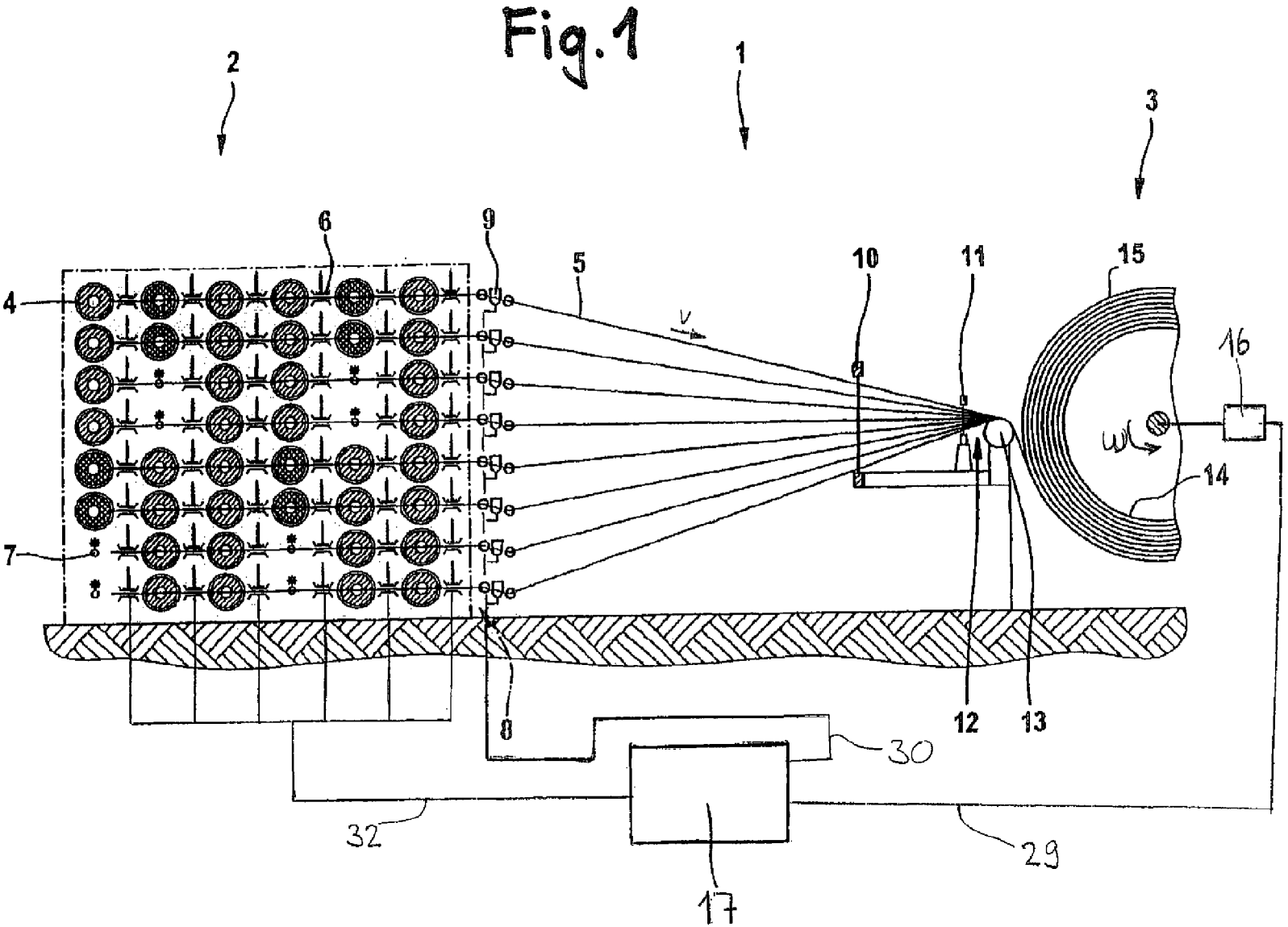

| | | | | | |
|---|---|---|---|---|---|
| 3,966,133 | A | * | 6/1976 | Gelin | 242/472.8 |
| 4,200,212 | A | | 4/1980 | Hartig et al. | |
| 4,819,310 | A | * | 4/1989 | Beerli et al. | 28/185 |
| 4,916,783 | A | * | 4/1990 | Hagewood et al. | 28/172.1 |
| 4,924,567 | A | * | 5/1990 | Hagewood et al. | 28/185 |
| 5,027,484 | A | | 7/1991 | Baba et al. | |
| 5,588,194 | A | * | 12/1996 | Ulbrich et al. | 28/194 |
| 5,957,402 | A | * | 9/1999 | McEathron et al. | 242/418.1 |
| 6,016,850 | A | * | 1/2000 | Zimmermann et al. | 139/97 |
| 6,206,320 | B1 | * | 3/2001 | Kusters et al. | 242/477.4 |
| 6,511,011 | B2 | * | 1/2003 | Zeller et al. | 242/419.1 |
| 6,513,748 | B2 | * | 2/2003 | Zeller et al. | 242/419.1 |

FOREIGN PATENT DOCUMENTS

| | | |
|---|---|---|
| DE | 19521524 | 12/1996 |
| EP | 1162295 | 12/2001 |
| WO | 03/091136 | 11/2003 |

* cited by examiner 30
31
29
ΔT
To
To
32

METHOD AND DEVICE FOR OPERATING A CREEL DESIGNED FOR A WINDING SYSTEM AND CORRESPONDING CREEL

The invention relates to a method and a device for operating a creel designed for a winding system and a corresponding creel according to the preambles of the independent claims. Methods of this type are aimed at as optimal a tension equalization as possible for all the threads on a creel, because the different running lengths of the threads between bobbin stations and the winding machine and the thread routing associated with this will lead to different thread tensions without corresponding equalization. This will result in an uneven winding density.

Methods for operating a creel are already known, in which the thread pull of each thread is to be kept as near as possible to a constant desired value. Thus, for example, EP-A-1 162 295 describes a method for operating a creel for a warping system having a plurality of bobbin stations, in which method the respective thread is acted upon with a braking force by a thread tensioner at each bobbin station. The thread pull is in this case measured continuously during the winding operation. The thus measured actual value of the thread pull or of the initial thread tension is compared with a desired value and, if a deviation is detected, is approximated to this, each thread tensioner being activated via a corresponding drive motor. It has been shown, in practice, that the regulating method described admittedly achieves good results during normal operation at a constant rotational speed of the winding machine, for example a cone warping machine. However, in other operating states, in particular during the run-up or stopping operation, regulation is often overtaxed. Particularly in winding systems with long thread sections between the creel and winding machine, it has proved difficult to handle the method. In high-speed operations, particularly during the run-up or during a stop of the winding machine, the thread section may oscillate due to too rapid a tension adaption during the regulation of the thread pull. The threads may tear (in the case of too great a thread pull) or sag (in the case of too low a thread pull, risk of entanglement).

An object of the present invention, therefore, is to avoid the disadvantages of what is known, in particular to provide a method of the type initially mentioned, which ensures an optimal equalization of the tension of all the threads even during nonstationary operating states, particularly during a run-up operation or a stopping operation. In particular, the thread pull of each thread is to be capable of being maintained at an especially constant desired value in all operating states. The method is to be suitable particularly for winding systems having long thread sections between the creel and winding machine. The installation of a device for operating the creel is, further, to entail as little cost as possible.

These objects are achieved, according to the invention, by means of a method which has the features in claim 1.

Winding machines, for example a cone warping machine with a warping drum, rotate at an angular speed. The angular speed may be approximately constant in stationary normal operation and vary in nonstationary operating states. At each bobbin station, the thread is acted upon with a variable braking force with the aid of at least one thread tensioner in order to generate a specific thread pull which corresponds essentially to the initial thread tension. To keep the thread pull at a desired value, each thread tensioner is controlled via the angular speed of the winding machine during a run-up operation and/or a stopping operation. A run-up operation is in this context to be understood as meaning that nonstationary operating state in which the winding machine accelerates from zero to the stationary normal operation. During the stopping operation, a braking of the winding machine from stationary normal operation to a standstill takes place. Each thread tensioner has a drive motor assigned to it. To control the thread tensioner, a drive motor is activated. Each thread can thus be acted upon with the necessary braking force in a simple way. The angular speed can, further, be measured by simple means. The advantage of this control is that each thread tensioner is set exactly in all operating states, particularly even during the entire period of time of the run-up operation or stopping operation. As compared with regulation, the control of the thread tensioner during nonstationary operating states has the advantage that an oscillation build-up or an unfavorable excitation of the threads is avoided. Alternatively to the measurement of the angular speed, it is, of course, also conceivable for each thread tensioner to be controlled directly via the thread speed of the thread.

An input variable for controlling each thread tensioner is the thread speed. To control the thread tensioner, therefore, it may be advantageous if the angular speed of the winding machine is measured continuously during the run-up operation and/or the stopping operation and is converted into a thread speed. This takes place particularly advantageously by including the layer thickness of the thread package on the winding machine. The layer thickness can be measured by means of a corresponding device. Since the layer thickness depends essentially on the type of yarn, the layer thickness could even be calculated without being measured. In this case, to achieve exact results, the pressure force of the pressing roller could also be included. By the angular speed of the winding machine being measured, the thread acceleration, too, can, of course, be detected in a similar way to the thread speed. Thus, during the nonstationary operating states, the behavior of the threads over the entire duration is known, thus ensuring an exact control of the thread tensioners. As mentioned above, it is also conceivable to measure the thread speed directly on the thread between the creel and winding machine.

The necessary braking force for controlling the thread tensioner may be calculated from the thread speed and from thread tensioner-specific and, in particular, motor-specific parameters of the drive motor of the thread tensioner. In particular, the motor inertia and the coefficient of friction of the drive motor come under consideration as control-relevant parameters for controlling the thread tensioner.

To determine a manipulated variable for the necessary braking force for controlling the thread tensioner, a disturbance variable compensation, with the thread speed as the input variable, can calculate a correcting variable. In this case, advantageously, at least the motor inertia and the coefficient of friction of the drive motor are to be compensated. The values for the motor inertia, the coefficient of friction and advantageously also the torque constant of the drive motor can be detected in a simple way. For example, the values for motor inertia, coefficient of friction and torque constant can be read out from data sheets of the respective manufacturers. Costly measuring devices may be dispensed with. The disturbance variable compensation can thus be carried out in a simple way. The drive motor may be torque-regulated, said manipulated variable and the correcting variable being in the form of currents. The above-described control of the thread tension during the run-up or stopping of the winding machine may be combined with regulation for the stationary phase (normal operation) of the winding machine. For this purpose, during normal operation, the actual value of the thread pull of each thread is detected continuously by a thread tension sensor and is regulated to the desired value by means of a controller. Such regulation is described, for example, in EP-A-1 162 295. This combined control and regulation ensures an optimal thread pull profile of all the threads in all operating states.

The controller can detect from the thread speed profile which operating state (run-up, normal operation, stop) prevails. At the time point of a change or transition from one operating state to another operating state (for example, run-up to a stationary normal operation), regulation is either switched on or switched off. For example, the threads have rising thread speeds during the run-up of the winding machine (in this case, particularly preferably, a constant acceleration is provided for the thread or for the winding machine). As soon as the thread acceleration is near to or exactly zero, the controller is switched on. Control can thus be changed to regulation in a simple way. Of course, the change from control to regulation (or vice versa) could also take place directly via the angular speed of the winding machine on the basis of specific final values.

A further aspect of the invention relates to a device, in particular a control and regulating device, for operating a creel for a winding system, in particular a warping system, with a creel having a plurality of bobbin stations of a winding machine for the joint winding of a plurality of threads of identical or different generic type, which are taken up from the bobbin stations. To maintain a constant thread pull of each thread, the device has a disturbance variable compensation for controlling the thread pull during the run-up operation and/or the stopping operation of the winding machine, which is operatively connected on the input side to a rotary encoder of the winding machine, said rotary encoder delivering a signal for the angular speed of the winding machine. The variable angular speed in this case represents the disturbance variable. Changes in the thread speed lead to a varying thread pull. With the aid of disturbance variable compensation, faults in the thread system can be compensated in a simple way. The control and regulating device can be used, in particular, for the above-described method for operating a creel for a winding system. Instead of being connected to the rotary encoder, the disturbance variable compensation could also be connected to a measuring device for measuring the thread speed of the threads, for example in the form of a deflecting roller.

The control and regulating device may have a speed measurement device by means of which the thread speed of the threads can be measured. The winding machine driven via the rotary encoder can deliver a signal for the angular speed of the winding machine, which signal can be converted into the thread speed. Alternatively, the thread speed could also be detected directly, for example, with the aid of a deflecting roller.

Further, a controller may be provided for regulating the thread pull during the normal operation of the winding machine. The combination of such a regulating device with a control device having disturbance variable compensation ensures a virtually optimal setting of the thread pull of each thread. The thread pull of each thread can thus be kept at an approximately constant desired value for each operating state in a simple way.

It is advantageous if a summing device for generating the manipulated variable for the necessary braking force for controlling the thread tensioner is provided, by means of which the correcting variable output by the disturbance variable compensation is added to (or subtracted from, depending on the sign) a desired value for the braking force of the thread tensioner. It is particularly advantageous if the summing device can also sum a controller correcting variable which is output by the controller for regulating the thread pull during the normal operation of the winding machine.

A control device with disturbance variable compensation and a regulating device with a controller may be provided for each thread. These components can be linked to one another via a bus system, in particular a CAN and/or PROFI bus system.

A further aspect of the invention relates to a creel which can be operated particularly according to the method of the abovementioned type and which may also be provided, in particular, with a control and regulating device of the above-mentioned type. The creel has a control device for controlling the thread pull as a function of the angular speed of the winding machine or of the thread speed of the threads during a run-up operation and/or stopping operation of the winding machine. Further, it has a regulating device with at least one controller for regulating the thread pull during the stationary normal operation of the winding machine. The control device and the regulating device are in this case configured in such a way that the thread pull of each thread can be kept approximately constant with respect to a desired value with the aid of the thread tensioners capable of being set via their drive motors. Particularly suitable drive motors are direct-current motors.

Dynamic thread tensioners are advantageously to be selected as thread tensioners (or thread brakes). Such thread tensioners may have at least one rotatable rotary body with an axis of rotation, the thread engaging at least partially on the circumferential region of the rotary body for action with a braking force, and the rotary body being drivable via the respective drive motor for setting the braking force. Such thread tensioners have been described, for example, in EP-A-950 742 or in U.S. Pat. No. 4,413,981. However, other thread tensioners, for example thread tensioners with disk brakes, but also, if appropriate, eye-type pretensioners or crepe-type pretensioners, may, of course, also be envisaged. Thread tensioners with a rotary body have, as compared with friction brakes, such as, for example, disk brakes, the advantage that the mass inertia of the rotary body has a beneficial (steadying) effect on the thread run. Thread tensioners with only one rotatable rotary body are, however, particularly suitable also because they have only a few control-relevant and regulation-relevant parameters and can therefore be handled simply.

Figure 2:
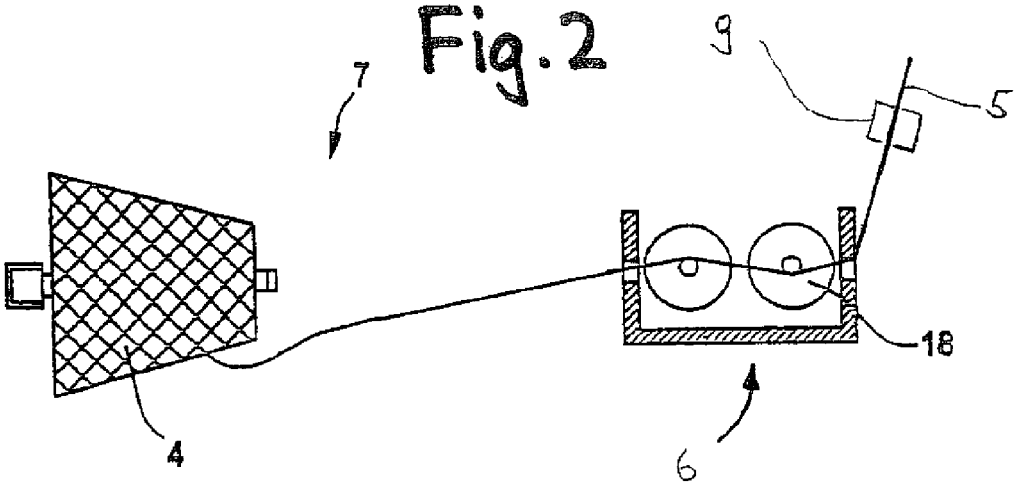
Figure 3:
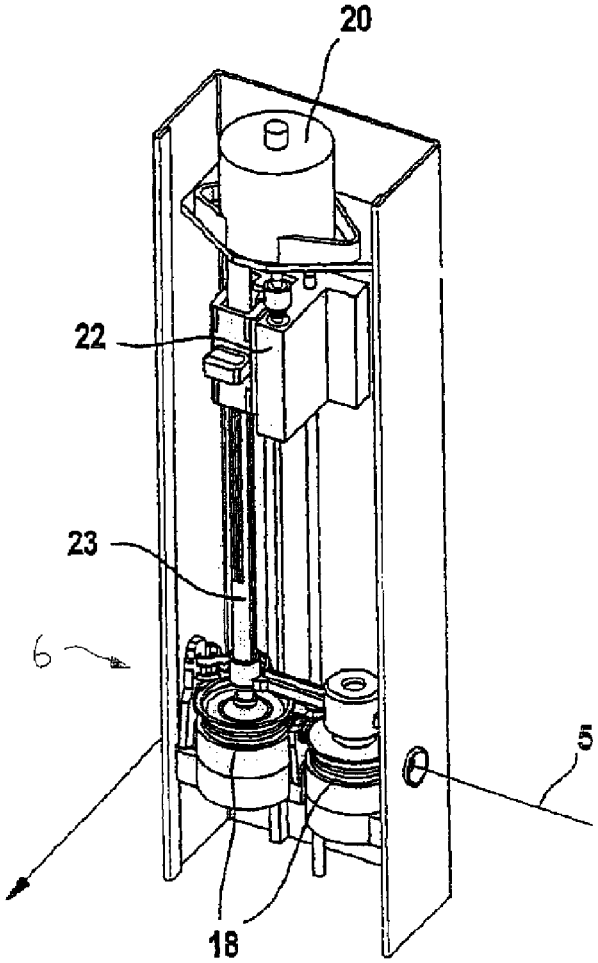
Figure 4:
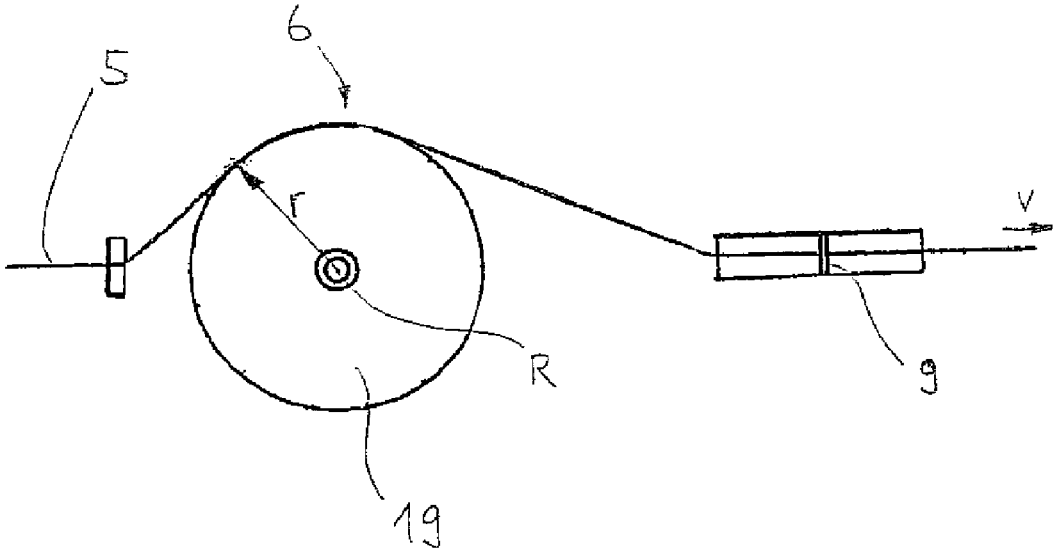
Figure 5:
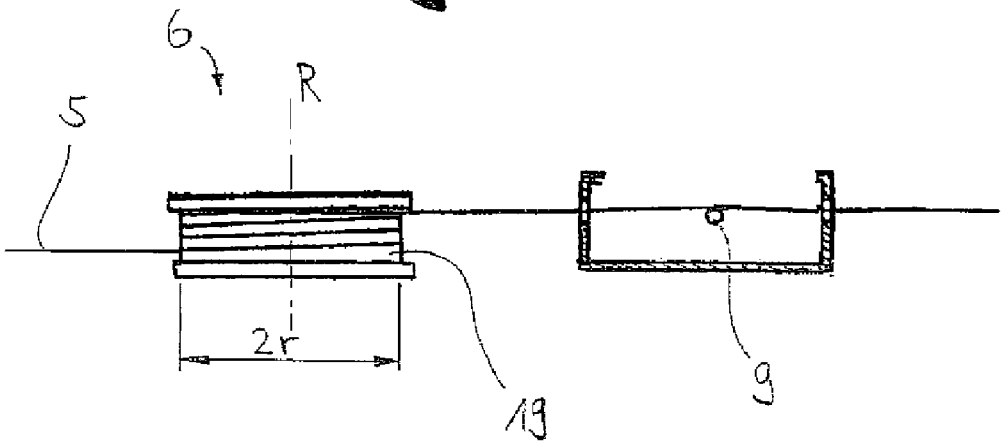
Figure 6:
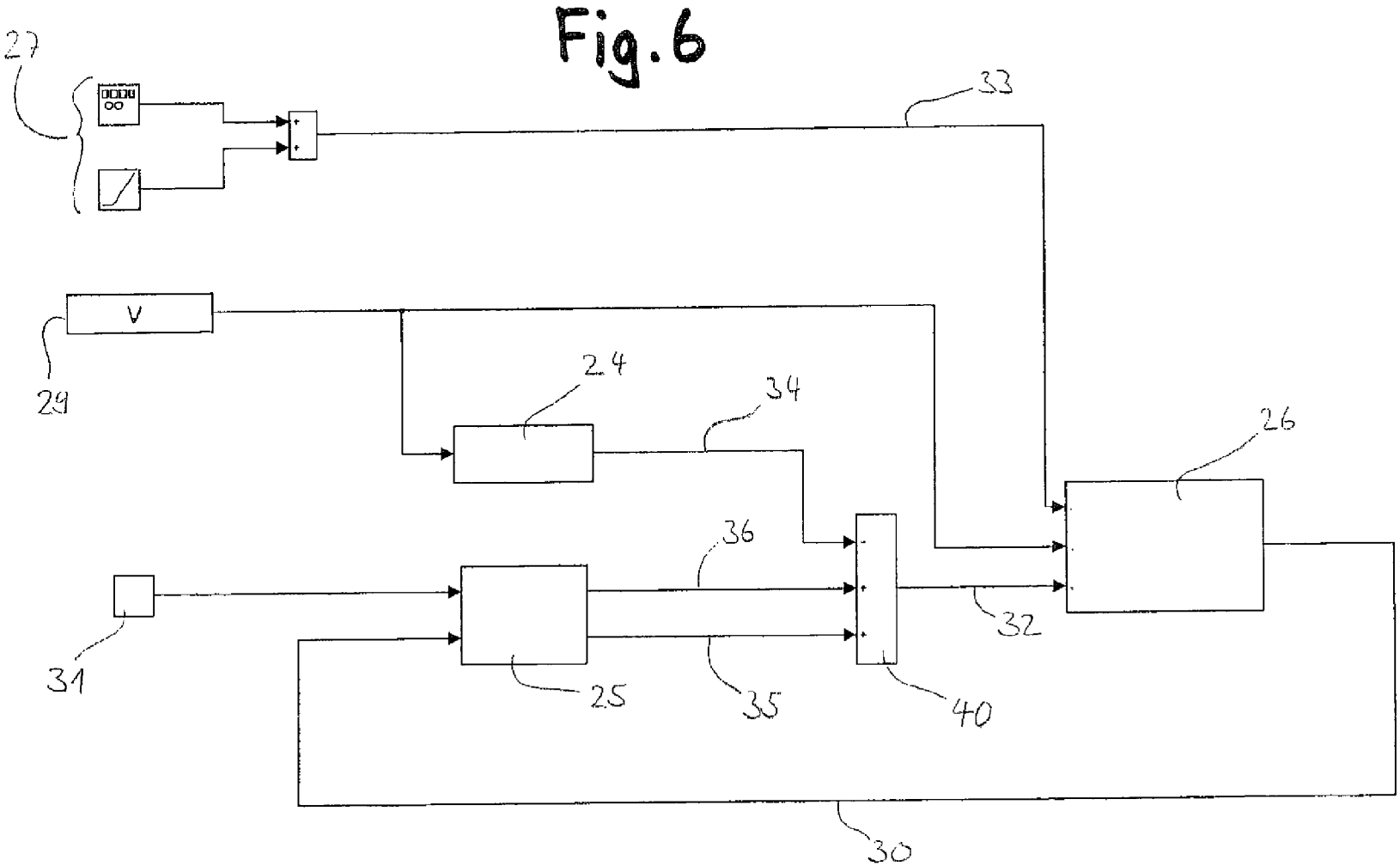
Figure 7:
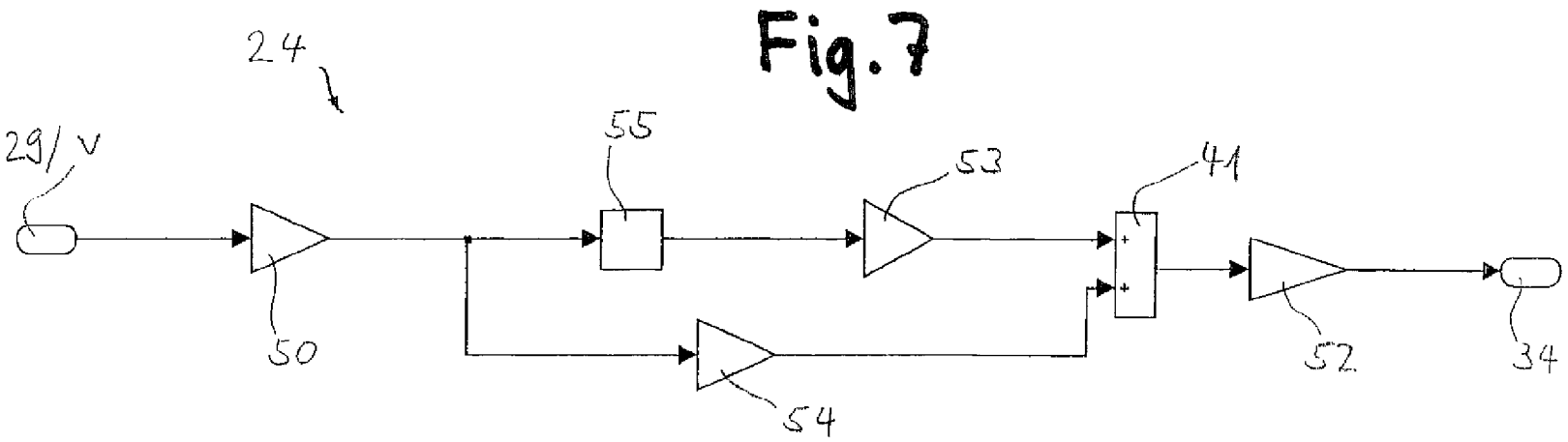
Figure 8:
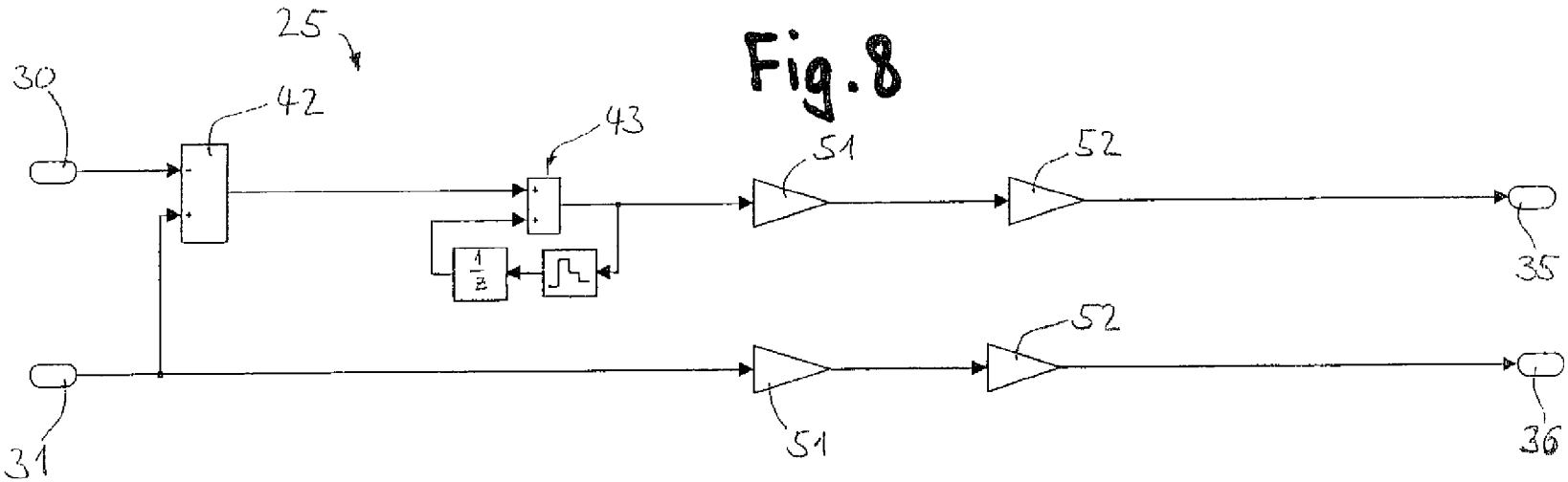
Figures 9A, 9B:
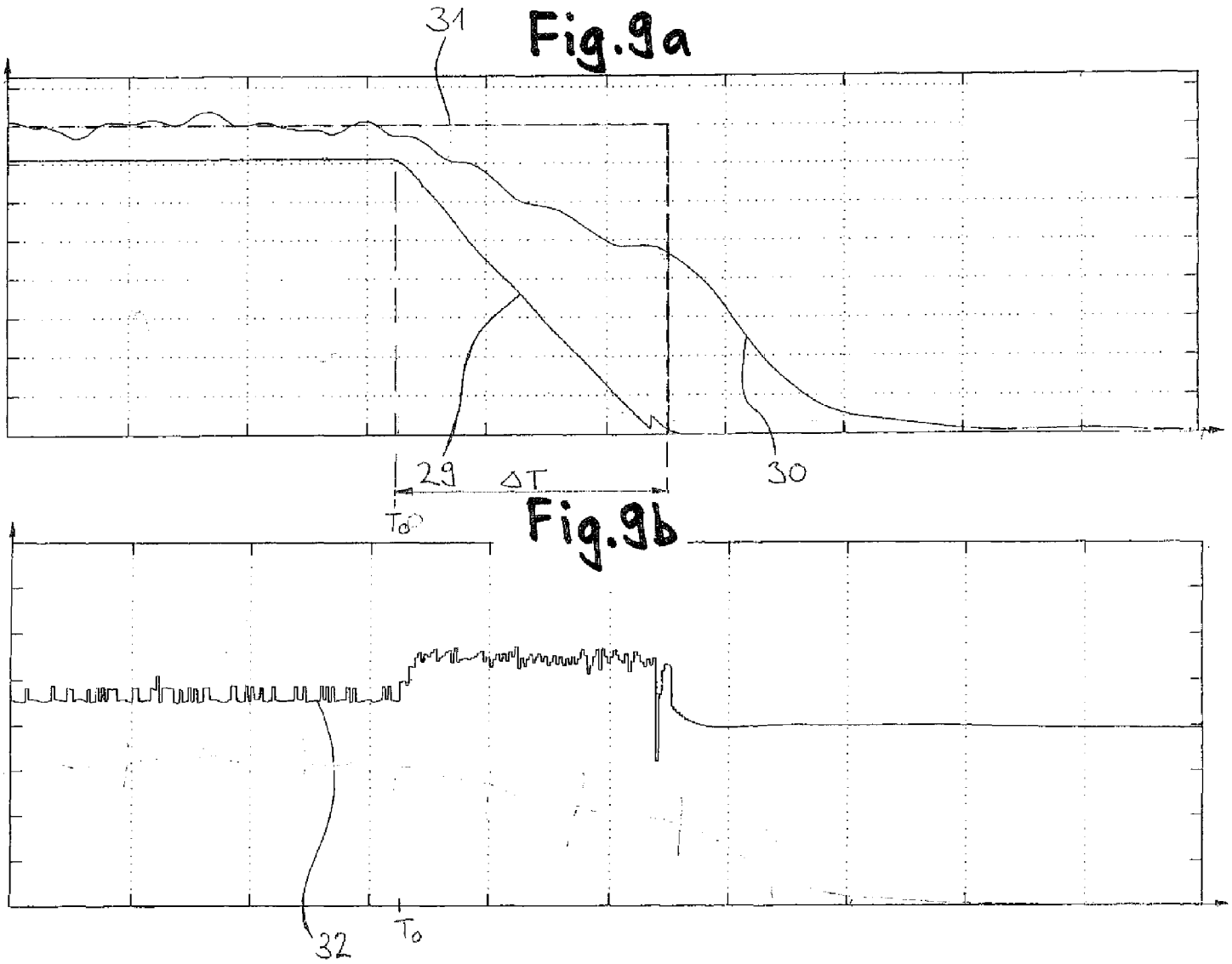
Figure 10:
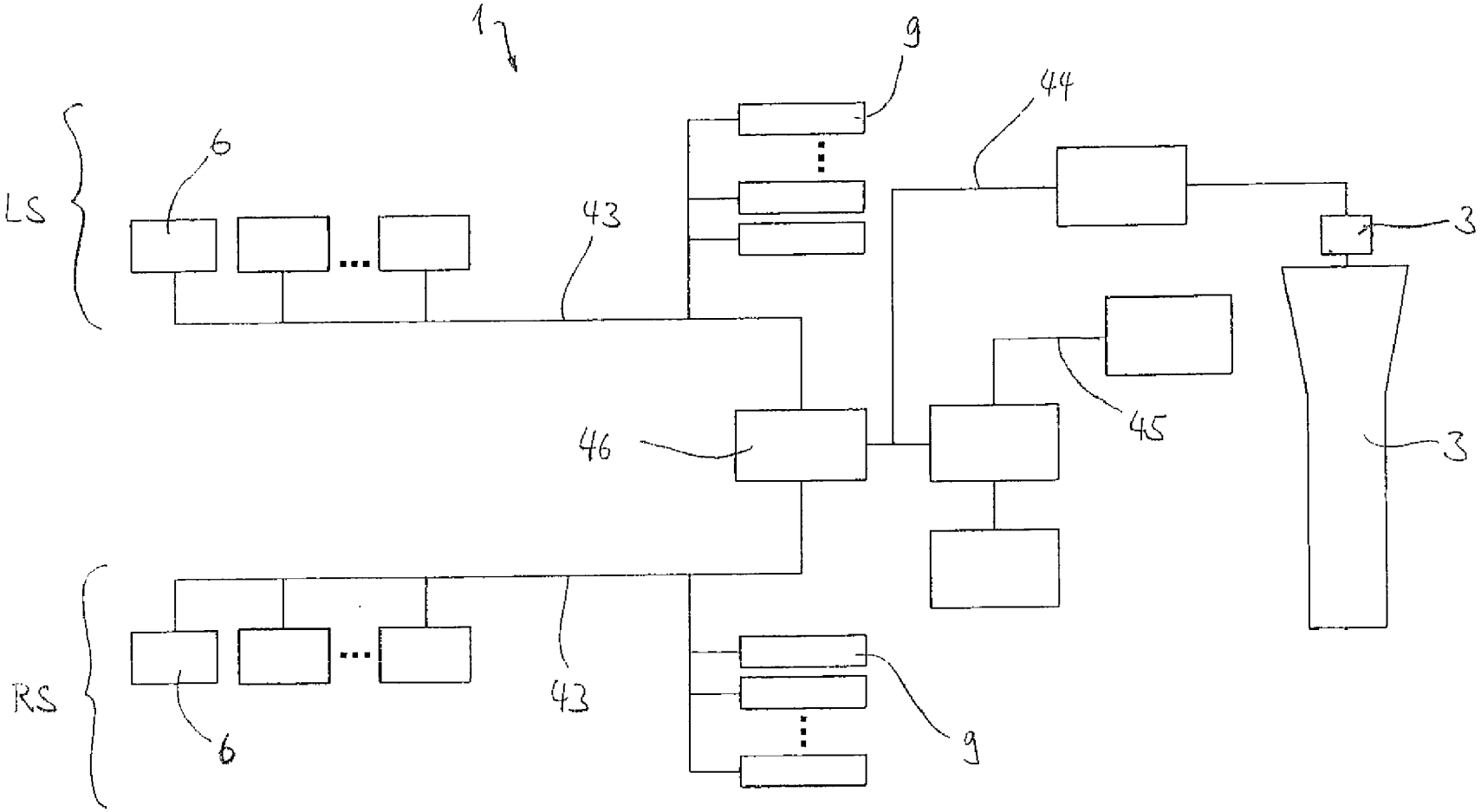

Further advantages and individual features of the invention may be gathered from the following description of exemplary embodiments and from the drawings in which:

FIG. 1 shows a diagrammatic side view of a winding system with a creel,

FIG. 2 shows a top view of an individual bobbin station with a thread tensioner and with a thread sensor, FIG. 3 shows a perspective illustration of the thread tensioner according to FIG. 2, FIG. 4 shows a top view of a thread tensioner and a thread sensor, FIG. 5 shows a side view of the thread tensioner according to FIG. 4, FIG. 6 shows a simplified block diagram of a control and regulating device of a winding system, FIG. 7 shows a disturbance variable compensation for the control and regulating device according to FIG. 6, FIG. 8 shows a controller for the control and regulating device according to FIG. 6, FIG. 9*a* shows a measured profile of the thread pull during a stopping operation of the winding machine, FIG. 9*b* shows an associated profile of the actuating current for the drive motor of FIG. 9*a*, and FIG. 10 shows a highly diagrammatic view of the winding system.

FIG. 1 shows a winding system, designated by 1, for example a warping system, with a creel 2 and with a winding machine 3, for example a cone warping machine. However, single-warp or beaming machines may, of course, also be envisaged. The individual thread bobbins 4 are attached to bobbin stations 7 of the creel, and the jointly taken-up threads 5 pass in each case through at least one thread tensioner (or thread brake) 6 in order to maintain a predetermined thread pull. The example according to FIG. 1 shows a parallel creel. The bobbins in this case form vertical and horizontal rows, in each case a vertical row on each creel side forming a thread group, of which the thread run length from the bobbin station to the winding machine is identical. However, the same principle may also be employed in any other creel type, for example in a V-creel.

Bobbins of different generic type, for example of different yarn qualities or different yarn colors, can be attached to the creel, independently of the thread run length, at different stations. The threads of different generic type can be exposed in each case to an individual braking force independently of what is known as the creel length compensation.

The thread tension sensors 9 for each individual thread are preferably arranged in the region of the creel side 8 which lies nearest to the winding machine 3. However, the arrangement of the thread tension sensors at this point is not mandatory. Basically, it would be advantageous to lead the thread tension sensors as near as possible to the winding point of the winding machine.

After leaving the creel, the threads pass into the region of the winding machine 3, where they first pass through a leasing reed 10, in which the threads acquire their correct sequence. The threads are subsequently supplied to the warping reed 11 in which they are brought together in order subsequently to be wound as a thread composite 12 onto the package 15 or onto the winding beam 14 via a deflecting and/or measuring roller 13.

A control and regulating device 17 is provided for operating the creel 2 for the winding system 1. This device 17 is connected to a rotary encoder 16 for the rotation of the winding machine 3. In the highly diagrammatic illustration according to FIG. 1, the device 17 receives on the input side a signal 29 from the rotary encoder 16 and signals 30 from the tension sensors 9. The device 17 is connected on the output side to the thread tensioners 6 which are controlled and regulated by means of the manipulated variable 32. For example, a signal for the angular speed ω may be provided as the input signal 29. A particularly suitable input signal 29 is a signal for the thread speed v which can be calculated, for example, from the angular speed ω and the measured thickness of the package 15. However, the thread speed v could also be measured directly with the aid of the deflecting roller 13.

FIG. 2 shows, for example, how a thread 5 unwound from a bobbin 4 runs through a thread tensioner 6. The braking force is applied here by a disk brake 18 having two brake actuator units arranged one behind the other in the thread run direction. The disk brake is accommodated in a U-shaped vertical supporting profile, in the U-leg of which are arranged thread guide eyes for the passage of the thread 5. FIG. 3 shows further details of the thread tensioner with the disk brake. An individual drive motor 20 is fastened directly in the supporting profile above each disk brake 18. This drive motor actuates, via an adjustment support 22, a pressure element 23 which loads or relieves the brake disks.

However, thread tensioners with only one rotatable rotary body have proved particularly suitable. As shown in FIG. 4, a particularly suitable thread tensioner 6 consists of only one rotatable rotary body which is connected to a drive motor (not shown). The rotary body is in this case configured as a yarn wheel 19 which has a radius r and an axis of rotation R. As is evident from FIG. 5, the thread 5 is wound multiply around the roller 19. However, a single winding may, of course, also be sufficient. The thread pull of the thread 5 is then measured with the aid of a thread sensor 9. The following description of the control and regulating device relates to the thread tensioner according to FIGS. 4 and 5. The set-up and operating mode of such a yarn wheel are described, for example, in EP-A-950 742. However, in particular, a yarn wheel known from U.S. Pat. No. 4,413,981 could also be provided as a yarn wheel. Of course the control and regulating principle described below could also be employed for other dynamic thread tensioners (cf. FIG. 2/3). Thus, roller tensioners, in which the thread is guided between two rollers via a nip, would also be suitable.

FIG. 6 shows a block diagram with a control and regulating device for operating the creel for the winding system. A controlled system for the thread is designated by 26. A controller 25 regulates the thread pull during stationary normal operation of the winding machine. Such a regulating method is known, for example, from EP-A-1 162 295. The continuously measured ACT value 30 of the thread pull is compared in the controller 25 with the corresponding DES value 31 and, if a deviation of the ACT value from the DES value is detected, the thread tensioner is adjusted with the aid of the controller in such a way that the ACT value approaches the DES value. Consequently, the controller 25 delivers on the output side a signal 36 which corresponds to a stationary current for driving the drive motor, and a correcting variable 35 which covers and includes the deviation of the DES value from the ACT value. In a summing unit 40, the two signals 35 and 36 are added up and deliver, for stationary normal operation, a manipulated variable 32 (actuating current) for the drive motor of a thread tensioner.

For special operating states, in particular for the run-up or stopping of the winding machine, the regulating method described may be somewhat unsuitable. This applies particularly to winding systems with long thread lengths. For these nonstationary operating states, such as the run-up or stopping of the winding machine, a disturbance variable compensation 24 is provided. The measured thread speed v serves in this case as input signal 29 for the disturbance variable compensation 24. The disturbance variable compensation 24 delivers on the output side a correcting variable (correcting current) 34 which is subtracted from the DES variable or the DES current 36 in the summing unit During the run-up operation or stopping operation, the correcting current 35 from the controller 25 may be, for example, zero.

FIG. 6 illustrates, further, at 27 the influence of the take-up from a bobbin, for example a cross-wound bobbin. A disturbance of the thread pull due to the take-up of the bobbin delivers a disturbance signal 33. The task of the controller 25 is in this case, in particular, to smooth out this influence.

FIG. 7 shows details of the disturbance variable compensation 24. By means of a multiplier 50 (l/r), the thread speed v is converted into the rotational speed of the yarn wheel having the radius r. A thread tensioner according to FIG. 4/5 is characterized by parameters of the drive motor in addition to the radius of the yarn wheel. The motor inertia J, the friction kr and the torque constant of the motor Km are therefore detected as control-relevant parameters.

A value for the acceleration of the thread is calculated with the aid of the unit 55. The multiplier 53 (motor inertia J) will convert the acceleration into a value for a torque. This torque is added in a summing unit 41 to a further torque which has been generated by the friction of the drive motor. For this purpose, the rotational speed of the thread wheel is multiplied by the friction kr (multiplier 54). Finally, the sum of the torques is converted by the multiplier 52 (torque constant 1/Km) into a correcting variable 34 (correcting current for a drive motor).

FIG. 8 shows a simplified block diagram of the controller 25. The DES value 31 for the thread pull is converted via the multipliers 51 and 52 (51: radius r; 52: torque constant 1/Km) into a DES current 36 for the drive motor of a thread tensioner. Further, by means of a summing unit 42, the deviation of the DES value 31 from the ACT value 30 is formed (the ACT value in this case has a negative sign) The thread pull difference thus formed is converted via an integrator 43 and subsequently via the multipliers 51 (radius r) and 52 (torque constant 1/Km) into a correcting variable or a correcting current 35.

FIGS. 9*a* and 9*b* show the profile of the thread pull during a stopping operation and the associated profile of the manipulated variable or of the actuating current 32 for the drive motor of a thread tensioner. The curve 29 shows the thread speed of the thread. This is essentially constant up to a time point $T_0$ and goes in an approximately straight line during a time span $\Delta T$ to a standstill. The predetermined DES value for the thread pull is designated by 31. Clearly, up to the time point $T_0$, the measured ACT value 30 runs in a narrow band range along the constant DES value by virtue of regulation. At the time point $T_0$, the change from the regulation to the control of the thread tensioner then takes place. As curve 30 shows, this is relatively near to the DES straight line 31 during the time span $\Delta T$. FIG. 9 shows that, from the time point $T_0$, an increased actuating current 32 for braking the drive motor is used in order to control the thread tensioner.

FIG. 10 shows a highly diagrammatic illustration of a winding system 1 controlled and regulated according to the method described above. The thread tensioners 6 and the thread sensors 9 are in this case allocated to the left side (LS) and the right side (RS) of the creel. In order to process the high data quantities, the individual components are connected to one another via data lines 43 and 44 which operate, for example, on the CAN bus principle. The data line 45, which connects a memory-programmed control of the winding machine to a memory-programmed control (SPS) of a creel, may be designed as a PROFI bus.

The invention claimed is:

1. A method for operating a creel for a winding system having a plurality of bobbin stations, in which method a plurality of threads are taken up from the bobbin stations jointly by means of a winding machine rotating at an angular speed, the thread being acted upon with a variable braking force at each bobbin station with the aid of at least one thread tensioner in order to generate a specific thread pull, the thread tensioner being activated by a drive motor wherein, during a run-up operation and/or a stopping operation of the winding machine, each thread tensioner is controlled via the angular speed of the winding machine, in order to keep the thread pull of each thread approximately constant with respect to a desired value.

2. The method as claimed in claim 1, wherein the angular speed of the winding machine is measured continuously during the run-up operation and/or the stopping operation and is converted into a thread speed, each thread tensioner being controlled by means of the thread speed as an input variable for the control.

3. The method as claimed in claim 1, wherein a braking force for controlling the thread tensioner is calculated from thread speed and parameters of the drive motor of the thread tensioner.

4. The method as claimed in claim 1, wherein, to determine a manipulated variable for a braking force for controlling the thread tensioner, a disturbance variable compensation, with thread speed as an input variable, calculates a correcting variable.

5. The method as claimed in claim 1, wherein, to determine a manipulated variable for a braking force for controlling the thread tensioner, a disturbance variable compensation, with thread speed as the input variable, calculates a correcting variable compensated by at least the motor inertia and the coefficient of friction of the drive motor.

6. The method as claimed in claim 1, wherein, during steady-state operation of the winding machine, the actual value of the thread pull of each thread is detected continuously by a thread tension sensor and is regulated to the desired value by means of a controller.

7. A device for operating a creel for a winding system with a creel having a plurality of bobbin stations and with a winding machine for the joint winding of a plurality of threads of which are taken up from the bobbin stations, for maintaining a constant thread pull of each thread, wherein the device has a disturbance variable compensation for controlling the thread pull during the run-up operation and/or the stopping operation of the winding machine, which is operatively connected on an input side to a rotary encoder of the winding machine, by means of which rotary encoder a signal for the angular speed of the winding machine can be generated.

8. The device as claimed in claim 7, wherein a speed measurement device is provided, by means of which thread speed can be measured on the basis of the angular speed of the winding machine.

9. The device as claimed in claim 7, further comprising a controller for regulating the thread pull during steady-state operation of the winding machine is provided.

10. The device as claimed in claim 7, further comprising a summing device for generating a manipulated variable representing a braking force necessary for controlling the thread tensioner which summing device adds a correcting variable output by the disturbance variable compensation to a desired variable for the braking force of the thread tensioner.

11. A creel having a plurality of bobbin stations, from which a plurality of threads can be taken up simultaneously by means of a winding machine, and having at least one dynamic thread tensioner which is assigned to each bobbin station and which the thread can be acted upon with a variable braking force in order to generate a specific thread pull, each thread tensioner being activatable by means of a respective drive motor further comprising a control device for controlling thread pull as a function of angular speed or thread speed during a run-up operation and/or a stopping operation of the winding machine and a controller for regulating thread pull during steady-state operation, the control device and the controller being configured in such a way that thread pull or initial thread tension of each thread can be kept approximately constant with respect to a desired value.

12. The creel as claimed in claim 11 wherein each thread tensioner has in each case at least one rotatable rotary body with an axis of rotation, the thread engaging at least partially on the circumferential region of the rotary body for action by a braking force and the rotary body can be driven via the respective drive motor in order to set the braking.

13. The creel as claimed in claim 12, wherein the thread is wound at least once around said rotary body.

* * * * *